United States Patent [19]

Ward et al.

[11] Patent Number: 4,971,580

[45] Date of Patent: Nov. 20, 1990

[54] HIGH DENSITY ELECTRICAL CONNECTOR WITH TERMINAL RETENTION LATCH

[75] Inventors: Bobby G. Ward, King; Donald J. Zutaut, Winston-Salem, both of N.C.

[73] Assignee: AMP Incorporated, Harrisburg, Pa.

[21] Appl. No.: 451,473

[22] Filed: Dec. 15, 1989

[51] Int. Cl.[5] ..... H01R 13/424

[52] U.S. Cl. ..... 439/595; 264/272.13; 264/318; 439/594; 439/598

[58] Field of Search ..... 439/595, 594, 598; 264/318, 277, 272.13

[56] References Cited

U.S. PATENT DOCUMENTS

| | | | |
|---|---|---|---|
| 4,722,704 | 2/1988 | Van Der Stuyf et al. | 439/851 |
| 4,863,400 | 9/1989 | Sato | 439/595 |
| 4,891,021 | 1/1990 | Hayes et al. | 439/599 |

FOREIGN PATENT DOCUMENTS 17093 5/1984 Japan .

*Primary Examiner*—Paula A. Bradley

*Attorney, Agent, or Firm*—Robert W. Pitts

[57] ABSTRACT

High density electrical interconnections are established by using an electrical connector comprising a plurality of terminals held in position by resilient housing latches which form a part of an insulative housing. The latches protrude into cavities containing the terminals. Each latch has a longitudinally extending groove formed on one side of the latch to prevent warping or deformation on the latch during molding. The latches alleviate stresses which result from the uneven distribution of temperature during the molding process.

7 Claims, 6 Drawing Sheets

PRIOR ART

HIGH DENSITY ELECTRICAL CONNECTOR WITH TERMINAL RETENTION LATCH

BACKGROUND OF THE INVENTION

1. Field of the Invention

This invention relates to an electrical connector and more particularly relates to means for retaining a terminal within the electrical connector.

2. Description of the Prior Art

The improper installation of electrical connectors has long been a problem in assemblies containing large numbers of interconnected electrical circuits. Even though the specific electrical connector can perform adequately under normal circumstances, opens can occur when terminals are not properly positioned within electrical connector insulative housing and when mating electrical connectors are not properly mated. In addition to opens which result from improper installation, terminal and connector retention are also important because of the problems that can be encountered over the life of the particular device. For example excessive vibration can cause one connector to become disengaged from another connector. Furthermore, proper retention of contact terminals and connectors can result in unstable electrical interfaces which can result in corrosion thus leading to a gradual deterioration of the electrical interconnection.

A number of steps have been taken to improve the retention of contact terminals within electrical connectors and the mating integrity between two electrical connectors. For example plastic terminal latches or lances which comprise an integral part of an insulative housing are often used to retain terminals within the housing. These plastic terminal latches replace the metal latches on the contact terminals themselves which have been commonly used for a number of years. One problem with these metal latches is that they can easily be overstressed during terminal insertion resulting in significantly reduced in retention of pull-out capability. Furthermore, these metal latches have caused problems in the installation of electrical harnesses since they promote tangling of the harnesses. U.S. Pat. No. 4,722,704 discloses a high density socket contact receptacle intended for use with a pin header. This electrical connector provides a high density interconnect between wires and a harness and circuits on a printed circuit board. That connector includes both integral plastic latches forming a part of the insulative housing.

One problem which has been encountered on electrical connectors employing cantilever latch beams which are part of the insulative housing, such as that shown in U.S. Pat. No. 4,722,704 is that the latch beams can be deformed during molding. These cantilever latch beams tend to warp or bow outwardly during cooling of the molded housing. When the cantilever latch beams bow, latching protrusions on the ends of the cantilever latch beams are drawn outwardly away from the center of the cavities. Compensation for this tendency is not a problem for relatively large connectors because the latching protrusions can simply be enlarged. However, as connectors become more and more densely populated, there is less and less room for such compensation.

BRIEF DESCRIPTION OF THE DRAWINGS

FIG. 3 is a view similar to FIG. 2 showing the two connectors in mated relationship.

DETAILED DESCRIPTION OF THE PREFERRED EMBODIMENTS

Figure 1:
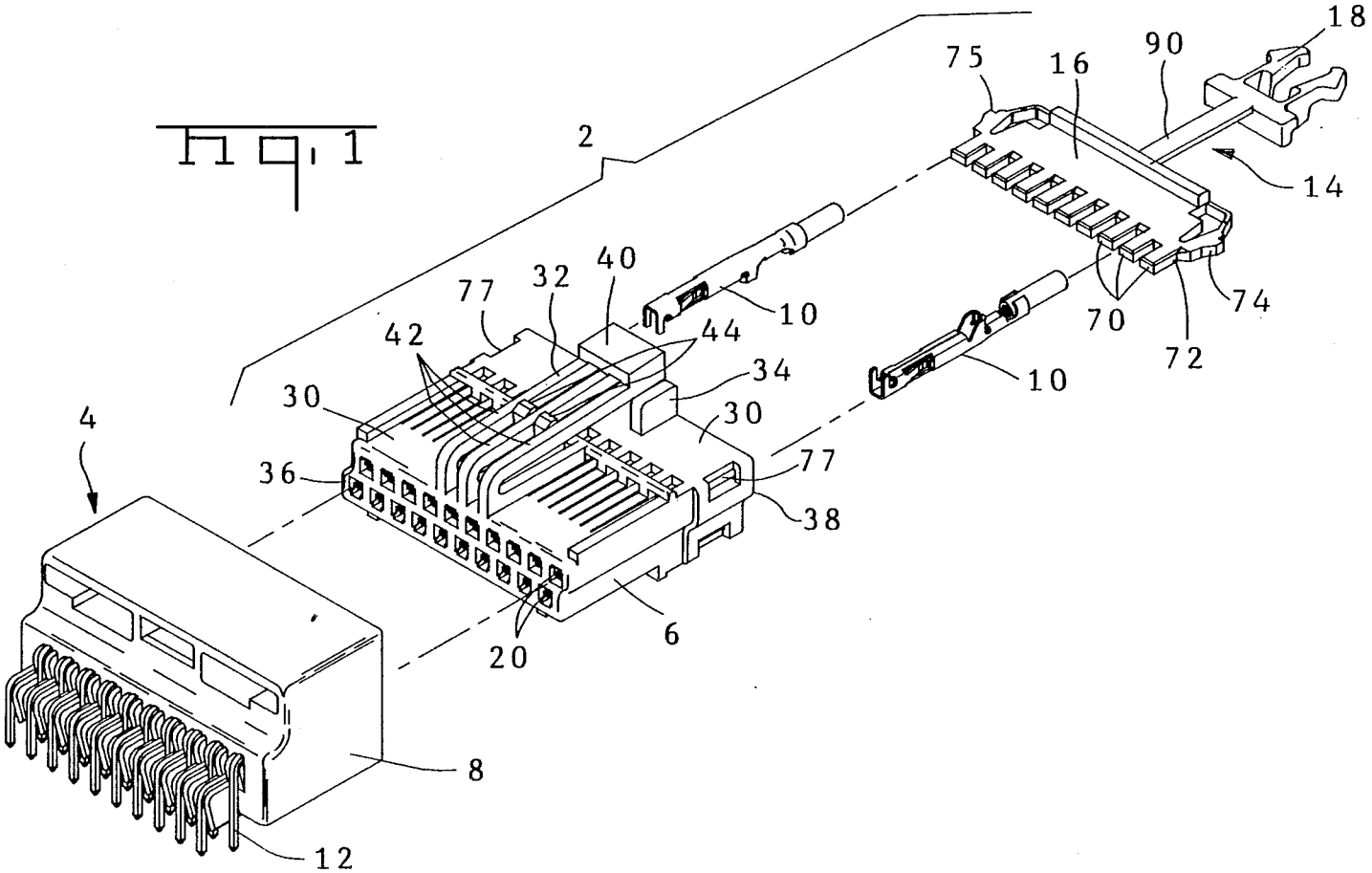
FIG. 1 is an exploded perspective view of the electrical connection comprising the preferred embodiment of this invention which is shown in conjunction with a right angle header.

The electrical connector 2 shown in FIG. 1 is matable with a right angle pin header 4. Electrical connector 2 comprises an insulative housing 6 in which a plurality of terminals 10 are positioned in two parallel rows. The mating pin header 4 also comprises an insulative housing 8 having a plurality of right angle header pins 12. The insulative housing 6 can be fabricated from a conventional engineering plastic such as glass filled LCP. Header housing 8 can also be fabricated from a conventional insulative material such as glass filled PBT. Terminals 10 can be fabricated from a conventional material such a phosphor bronze having a pre tin plating. Header pins 12 can be fabricated using square brass contacts with a tin over nikel plating. The electrical connector 2 also employs a one-piece terminal position and connector position assurance insert 14 (TPA and CPA, respectively) which in turn comprises a TPA insert 16 joined to a CPA 18 by an integral strap 90. The TPA and CPA insert 14 can be fabricated from a plastic such as acetal. In the embodiment shown in FIG. 1, the TPA and CPA insert 14 is used in combination with a separate TPA insert of the same construction as TPA 16 but without the integral CPA 18. The TPA and CPA insert 14 is used in conjunction with terminals 10 mounted in a row of cavities 20 in the housing which is located adjacent to an integral connector latch located on one side of the housing. Since the connector has only one connector latch 32, no CPA member is needed in conjunction with the terminals located in the other row of cavities 20 in the insulative housing 6. The connector 2 shown in FIG. 1 comprises a twenty position connector in which ten cavities 20 are located in each of two rows. It should be understood that electrical connectors having either a larger or smaller number of terminal positions can be fabricated in the same manner.

The plurality of cavities 20 in the insulative housing 6 extend from the mating end or mating face 36 to the rear face 38 of the insulative housing 6. Individual cavities 20 are positioned side-by-side in two parallel rows. Cavities in separate rows are offset. In the preferred embodiment of this invention the center line spacing between cavities in the same row is 3.O mm. Therefore the lateral spacing between adjacent cavities 20 in separate rows in 1.5 mm. Although the instant invention is particularly suited for use in a high density connector having terminals spaced apart on center lines of this order of magnitude, it could clearly be employed on larger connectors having less density and one of ordinary skill in the art would appreciate the similar configuration could be employed on smaller center line spacing.

The primary retention member holding terminals 10 within their respective cavities 20 comprises a molded resilient housing latch in the form of a cantilever latch beam 22 which comprises a part of each cavity 20. These molded cantilever latch beams 22 comprise an integral part of one side wall 30 of the insulative housing 6. These latches 22 extend rearwardly from the mating end 36 toward the rear face 38. Each latch 22 includes a latching projection 24 located on the free end of the cantilever latch beam which protrudes into the corresponding cavity 20. These cantilever latch beams 22 extend rearwardly to prevent terminals 10 from being withdrawn through the rear face 38 of the housing 6. Thus these cantilever latch beams are loaded only in tension and need not withstand any significant compressive load. Latches 22 which form a part of the insulative housing side wall 30 are separated by rigid sections of side wall 30 and outward deflection of latches 22 is prevented by a laterally extending overstress rib. Side wall openings are provided to permit access to the free ends 26 of latches 22. Thus the free ends 26 can be deflected outwardly relative to the latch base 28 but such deflection is limited by the laterally extending overstress rib.

Electrical connector 2 is held in mating engagement with the pin header 4 by a connector latch located adjacent side wall 30 on the insulative housing 6. Connector latch 32 comprises an integral part of the insulative housing 6. Connector latch 32 is inwardly depressible to permit a snap engagement of the insulative housing 6 to the header housing 8. Connector latch is also depressible to release the insulative housing 6 from the mating connector housing 8. Connector latch 32 includes a plurality of deflectable beams extending between the rear face 38 and the mating face 36 of the insulative housing. These deflective connector latching beams 42 have a fixed end adjacent to mating face of housing 6 and terminate in a common rear portion 40. This rear portion 40 is positioned between two spaced apart ribs 34 extending upwardly adjacent the rear face 38 of the insulative housing 6. These ribs 34 prevent excessive lateral movement of the connector latch 32. Connector latching shoulders 44 are positioned between adjacent connector latching beams 42 and have a forward inclined surface 46 and a rear vertical surface 48. Forward movement of the insulative housing 6 relative to the header housing 8 brings the forward inclined face 46 of shoulder 44 into engagement with a mating surface 49 thus causing the beams 42 to be inwardly deflected. Continued movement, however, brings the rear vertical face 48 of shoulder 44 into engagement with the mating surface 49 of the mating header housing 8 when the connectors are fully mated. Beams 42 can be cammed inwardly during mating between the two connectors.

Figure 2:
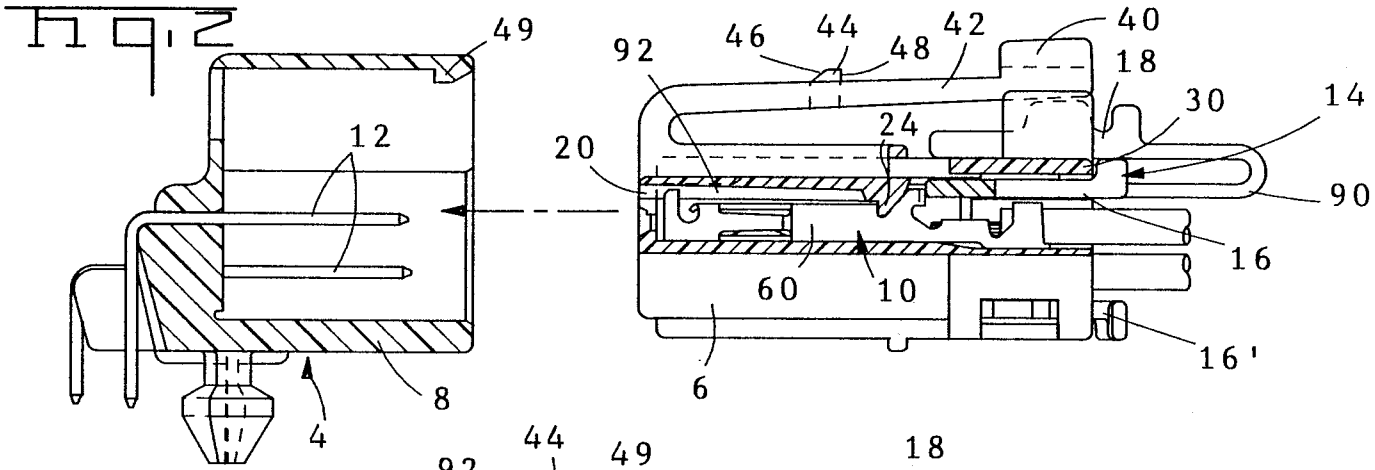
FIG. 2 shows sectional views of the receptacle electrical connector comprising the preferred embodiment of this invention with a right angle pin header.
Figure 1:
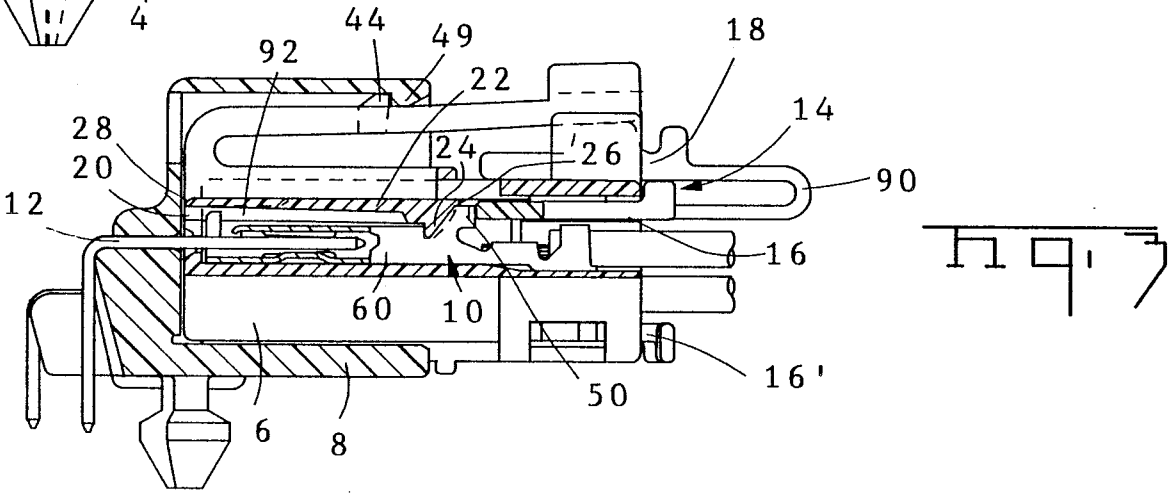
Figure 5:
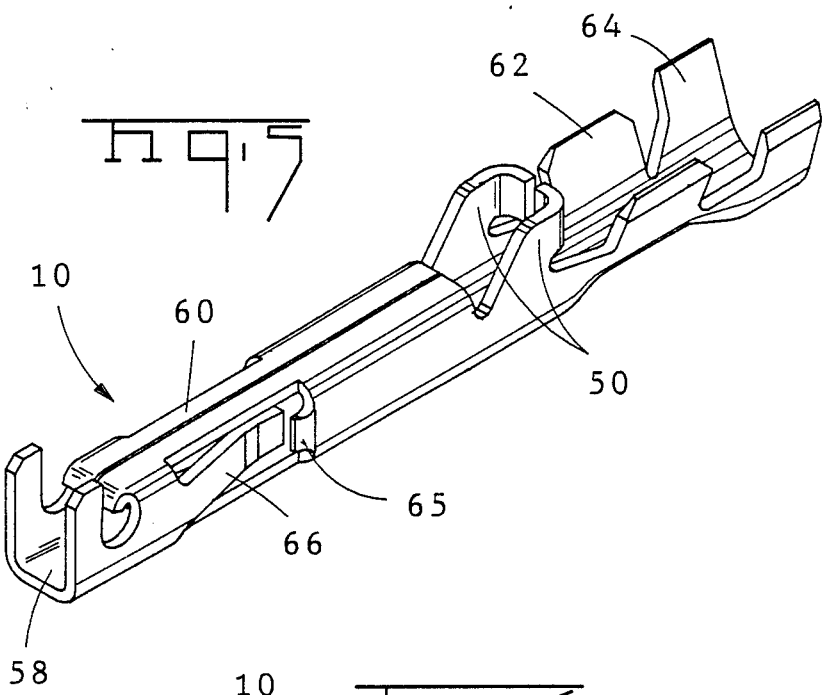
FIG. 5 is a perspective view of a receptacle terminal which can be employed in the electrical connector comprising the preferred embodiment of this invention.
Figure 6:
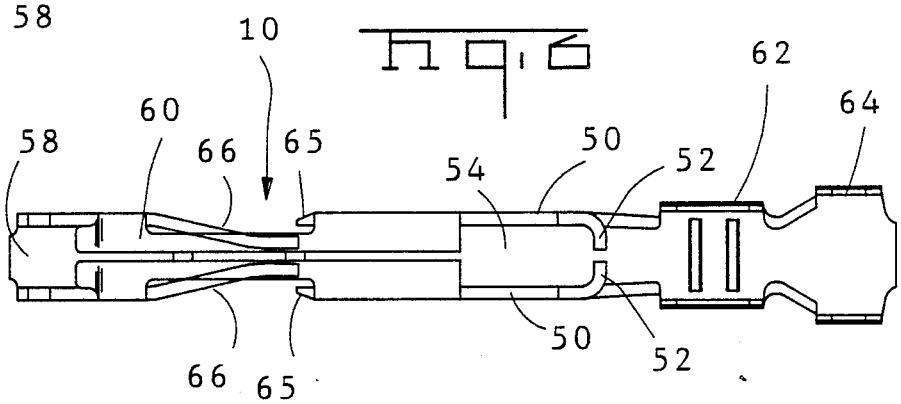
FIG. 6 is a plan view of the terminal shown in FIG. 5.
Figure 7:
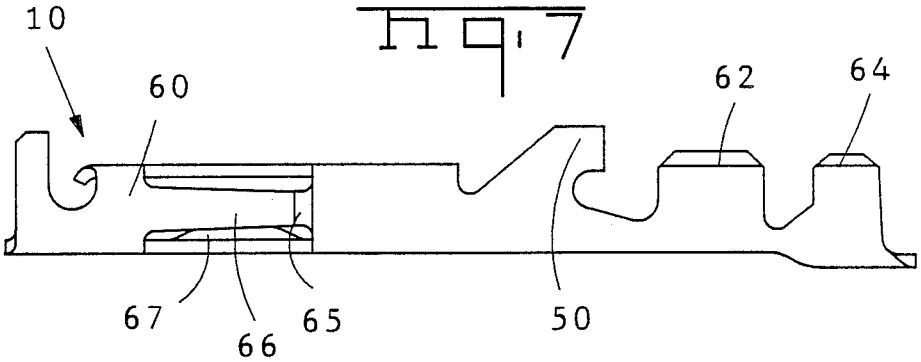
FIG. 7 is a side view of the terminal shown in FIG. 5.
Figure 8:
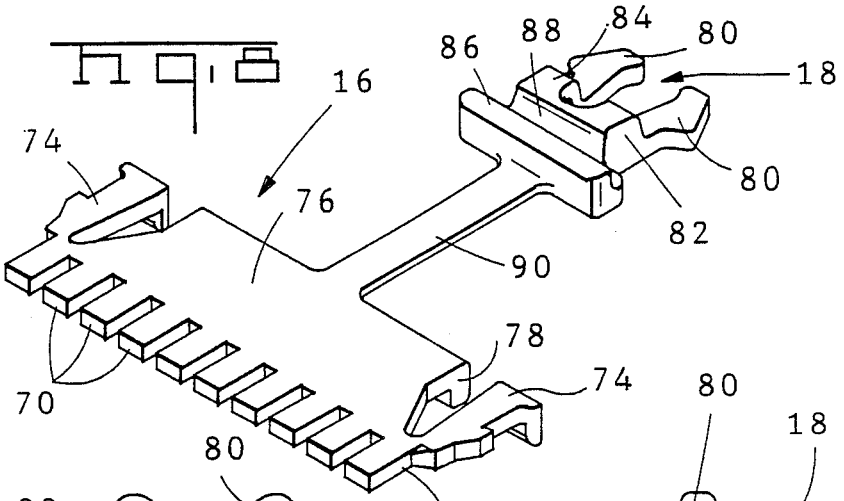
FIG. 8 is a perspective view of the one-piece terminal position and connector position assurance insert.
Figure 9:
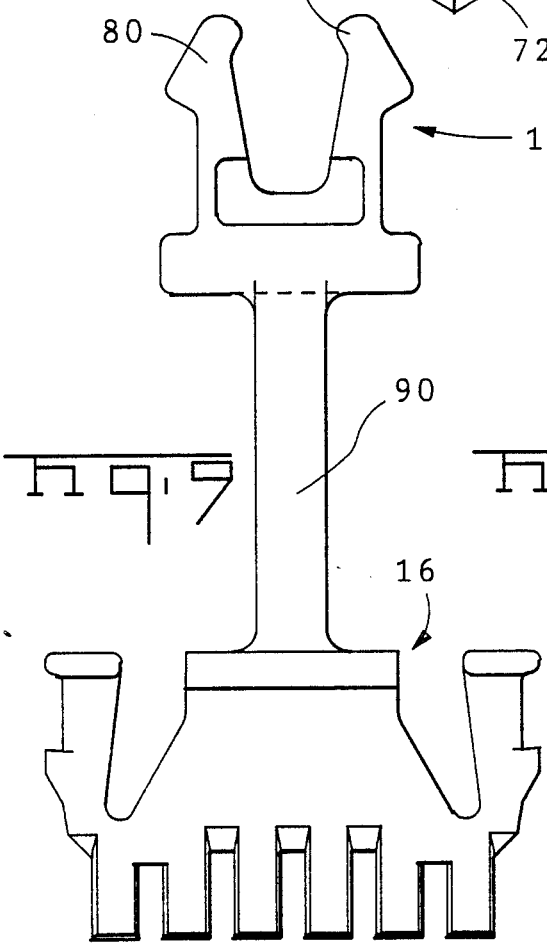
FIG. 9 is a plan view of the terminal position and connector position assurance insert.
Figure 10:
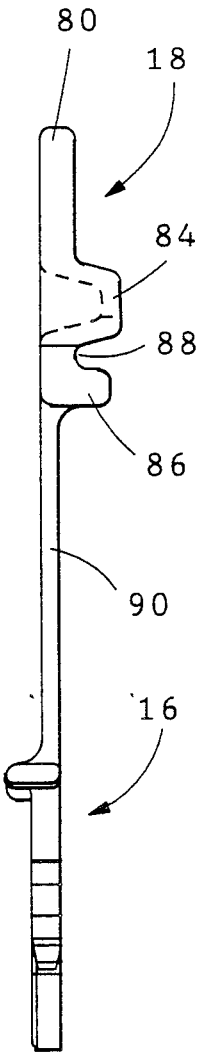
FIG. 10 is a side view of the terminal position and connector position assurance insert.

The receptacle terminals 10 used in electrical connector 2 are shown in more detail in FIGS. 5, 6 and 7. Each of a plurality of these stamped and formed terminals 10 is positioned within an individual cavity 20 in the insulative housing 6. Each terminal includes projections 50 intermediate its opposite ends. Projections 50 extend upwardly from opposite terminal side edges of the base 54. These projections 50 extend upwardly from opposite edges of base 54 in front of a wire crimp 62 and an insulation barrel 64 and between the wire crimp 62 and mating receptacle contact section 60. Projection 50 is bent with a flat side forming an ear 52 extending inwardly on the projection and facing the rear of the terminal 10 above the wire crimp 62 and the insulation barrel 64. Ears 52 overlap the base 54 and are formed so that a flat side of each ear faces the rear of the terminal 10. Wire crimp 62 is a conventional construction and the insulation barrel 64 has a height greater than the wire crimp 62 when each are formed around a wire in the matter depicted in FIG. 1. As shown in FIG. 1, projections 50 and ears 52 are in a position above both the wire crimp 62 and the insulation barrel 64. Ears 52 are formed inwardly so that the free ends 56 of each of the ears 52 are located in opposed relationship. The receptacle contact portion 60 is of generally conventional construction and includes inwardly formed resilient contact springs 66 suitable for establishing electrical continuity with a pin inserted into the receptacle section 60. A raised section 67 is located along the base of the receptacle contact 60 and is positioned so that a pin, inserted into contact section 60, will rest on the raised section 67 between opposed spring 66. When terminals 10 are inserted into cavities 20 from the rear of the insulative housing 6, resilient housing latches 22 will engage each of the terminals between the projections 50 and the mating end 58 of the terminal. In the preferred embodiment of this invention the latching projection 24 engages the mating receptacle contact portion 60 when the terminal is fully inserted into the corresponding cavity 20. As shown in FIGS. 2 and 3 this latching projection 24 engages the upper edge of the formed over receptacle contact section 60 immediately adjacent the projections 50. Note that the forward edge of projections 50 is included so that the projections 50 extend away from the rearmost projections 24.

The TPA and CPA member 14 is inserted into the insulative housing 6 from the rear. This one-piece member includes a TPA insert 16 in the form of a generally flat member located at one end of a strap 90 and a CPA insert 18 in the form of blocking member located at the opposite end. The TPA 16 is engageable with terminals 10 to hold the terminals in the cavities. TPA 16 is inserted into the insulative housing 6 from the rear. The generally flat TPA insert 16 is inserted into a slot located adjacent to the side wall 30 adjacent to the connector latch 22. This slot is formed by a gap between the side wall 30 and the upper edge of the inner walls which define the respective cavities 20. TPA insert 16 comprises a plurality of fingers 70, each finger being associated with one cavity 20. Each finger engages the rear flat side or ear 52 of the projection 50 on the corresponding terminal 10. If the terminal 10 is not properly in engagement with the terminal latch 22, insertion of the TPA insert 16 will push the respective terminal 10 into its fully seated position. The TPA insert 16 has a generally flat body 76 and the fingers 70 extend from a forward edge of that flat body. A bar 78 extends laterally along the rear edge of the TPA body 76 and forms a stop engageable with the surface on the rear end 38 of the insulative housing 6. The laterally extending TPA bar 78 also provides a means for extracting the TPA insert 16 from its slot in the insulative housing 6.

The slot into which the TPA insert 16 is inserted is located above the position occupied by the wire crimp 62 and the insulation barrel 64. Thus the TPA 16 engages the flat side of ear 52 ahead of the wire crimp 62 and the insulation barrel 64. The TPA 16 also engages the top of the insulation barrel 64 and urges the rear portion of the terminal 10 down against the bottom side of the corresponding cavity 20. Thus lateral movement of the rear of the terminal 10 is restricted. Engagement of the front of finger 72 with the flat ear 52 of projection 50 also increases the retention force supplied by the TPA 16. Retention forces of 30 pounds or more can be achieved using this configuration. A configuration in which the TPA 16 would engage a flat surface instead of an edge of projections increases retention forces from the range of 20 to 25 pounds to the range of 30 to 35 pounds, a significant increase in terms of the performance requirements for this type connector. The TPA 16 is held in the insulative housing 6 by latching springs 74 which protrude from side edges of the TPA 16 to secure the TPA in the housing. These latching springs 74 are inwardly deflectable and include a protruding tooth 75 which is received within a side recess 77 located adjacent the side wall 30 on an edge on the insulative housing 6.

The CPA insert 18 is engageable with the rear portion of 40 of connector latch 32 to hold the latch in engagement with the mating header 4. The CPA 18 prevents the rear portion 40 of the connector latch 32 from being depressed. The resilient beams 42 can, however, be deflected without depressing the rear portion 40 of the connector latch. CPA 18 is inserted between the rear portion 40 of connector latch 32 on the side wall 30 adjacent which the TPA 16 is located. CPA 18 is insertable between the two spaced apart ribs 34 and is thus trapped between these ribs 34, the rear portion 40 of the connector latch 32 and the side wall 30. The height of the CPA body 84 is sufficient to hold the rear portion 40 of connector latch 32 in position. A laterally extending CPA bar 86 is located on the rear of the CPA and is separated from the rest of the CPA body 84 by a lateral recess 88. This lateral recess assists an operator in removing the CPA since it provides a convenient gripping surface. For instance an operator may insert his thumb nail in recess 32 and exert a retraction force on the CPA bar 86 to withdraw the CPA from beneath the rear portion 40 of the connector latch 32. Latching springs 80 engageable with ribs 34 protrude from side edges 82 of the CPA insert 18 to secure the CPA in place. Both the TPA 16 and the CPA 18 have laterally protruding latching springs 74 and 80 respectively and the TPA 16 and the CPA 18 can be positioned side-by-side and substantially parallel to each other by simply bending or deforming the strap 90. This allows the TPA 16 to be inserted on the inside of housing side wall 30 while the CPA 18 is inserted on the outer surface of the side wall 30.

Figure 11:
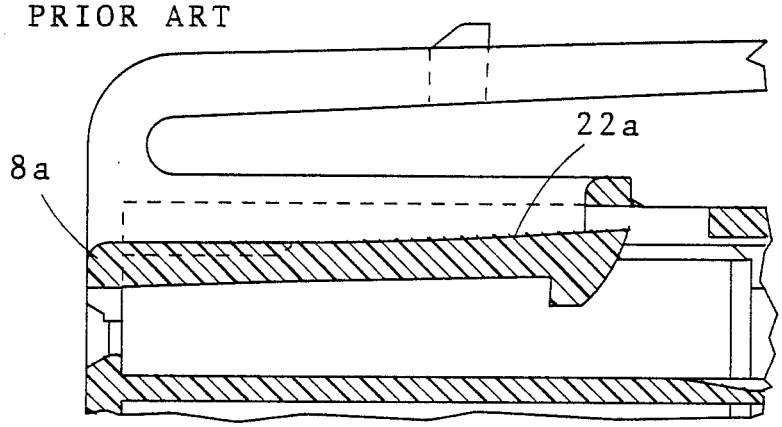
FIG. 11 is a sectional view of a prior art cantilever latch beam showing the undesireable outward bowing of the beam.

The connector depicted herein is a densely populated connector with the centerlines of adjacent cavities spaced apart by a distance of 3.0 mm. Adjacent rows of cavities are also spaced apart by a distance of 3.0 mm. The individual cantilever latch beams in each cavity are thus relatively small. Initially these cantilever latch beams were molded with a solid rectangular cross section in the manner of the prior art beams shown in FIG. 11. These solid cantilever beams **22*a* integral with housing 8*a* tended to bow outward as shown in FIG. 11. This outward warpage caused the latching projection 24*a* to move outwardly from its intended position. In other words the latching projection would be outwardly displaced relative to the center of the corresponding cavity 20*a*. Therefore the latching projection 24*a* would form a less secure locking engagement with a terminal in cavity 20*a*. The force required to retract a terminal would then be less than intended. Because of the small size of this cantilever latch and the limited space available in each cavity, it became impractical to merely enlarge the latching projection 24*a*** to compensate for this warpage.

The phenomenon which is believed to have caused this warpage is the uneven cooling of the molten plastic forming the housing and the cantilever latch beam. This uneven cooling is due to the temperature differential between the outer portions of the mold forming the exterior of the housing and the core pins which are employed to form the cavities. The core pins are significantly hotter than other portions of the mold. In some cases the temperature of the core pins approaches 510 degrees Fahrenheit while the temperature on the outside of the mold cavity can be from 180 to 200 degrees Fahrenheit. The outer portions of the cantilever latch beams **22*a* on the exterior of the housing and adjacent the mating end 36*a*, including the web 31*a*** which forms the base of each beam, therefore tend to cool more rapidly. As these portions of the beams cool they also tend to shrink, while at the same time the inner portions of the beams are hotter and are not subjected to the same stresses as the more rapidly cooling portions. As the portions of the beams adjacent the base and on the exterior of the beams shrink longitudinally, the beams warp or bow outwardly. This bowing tendency has therefore been attributed to differential cooling attributable to an uneven temperature distribution in the mold.

Figure 4:
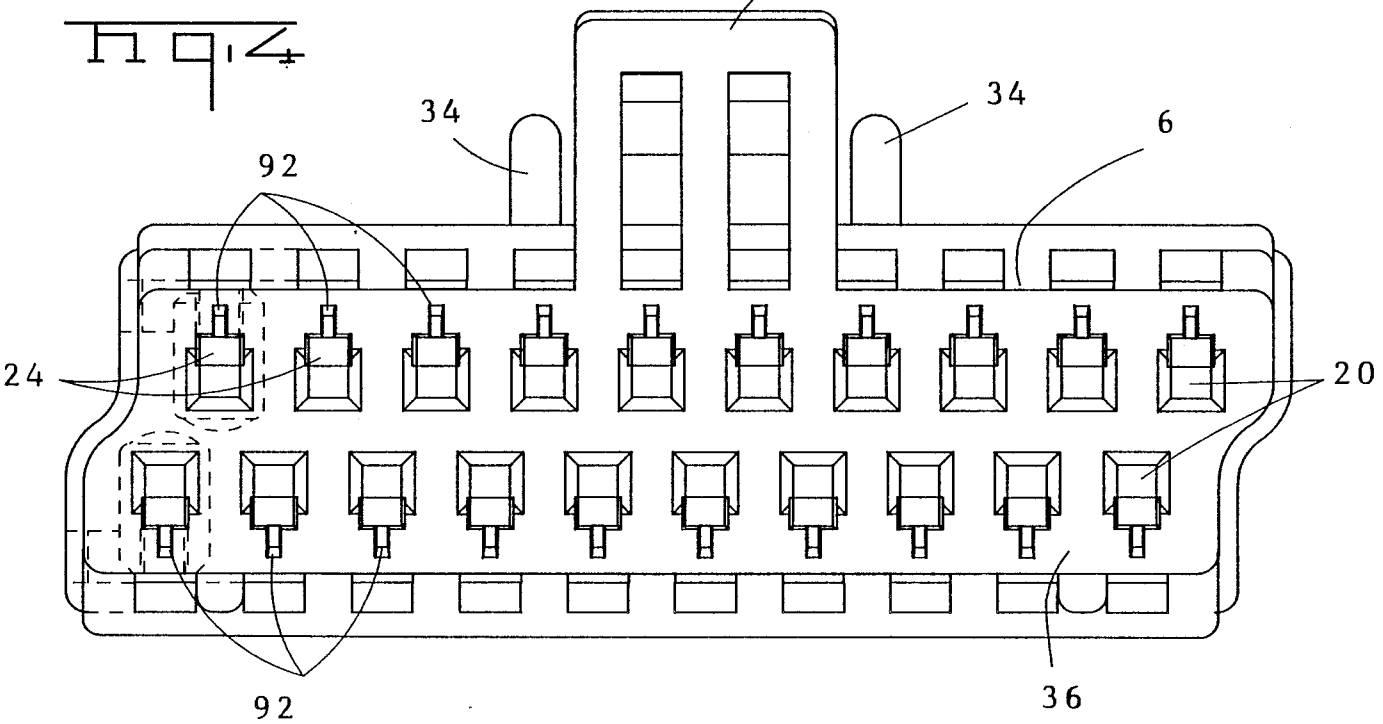
FIG. 4 is a front view of the insulative housing used in the electrical connector which comprises the preferred embodiment of this invention. Hidden lines are shown for one set of the cavities only.
Figure 12:
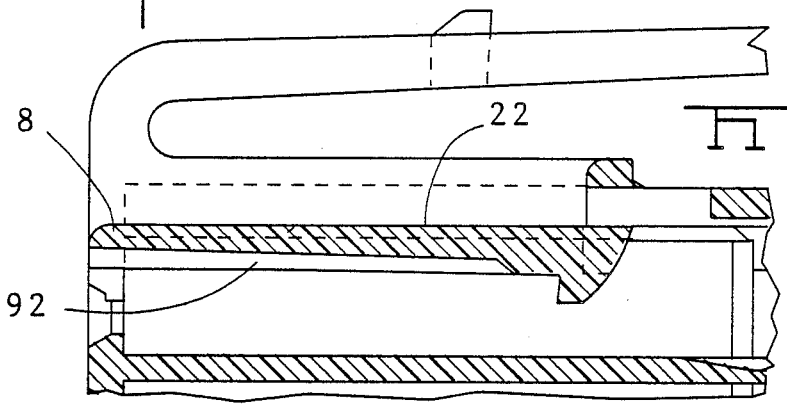
FIG. 12 is a sectional view of the cantilever latch beam of the connector embodiment depicted in FIGS. 1–10 showing the longitudinal groove on the interior of the cantilever latch beam extending from the base of the beam toward the free end. The configuration reduces or eliminates the outward bow.

The embodiment of the cantilever latch 22 depicted in FIG. 12 alleviated this warpage tendency. A longitudinally extending groove 92 on the inside of the cantilever latch beam 22 extends from the base of the beam at the mating face 36 of the housing 8 toward the latching projection 24 on the end of the beam. A cross section through beam 22 along the length of the groove 92 shows that the beam has a generally U-shaped cross section. Groove 92 extends through web 31 and opens onto the mating face 36 as shown in FIG. 4. As shown in FIG. 12 there is little if any warpage or bowing of beam 22. Since groove 92 is formed by a portion of the relatively hotter core pin forming cavity 22, the temperature distribution within the beam during cooling is altered in a manner which minimizes the tendency of the beam to shrink longitudinally. The precise mechanism is not fully understood, but portions of the beam on the outer half should be hotter, thus reducing the uneven longitudinal shrinkage and the interior of the beam can cool more rapidly.

Figure 13:
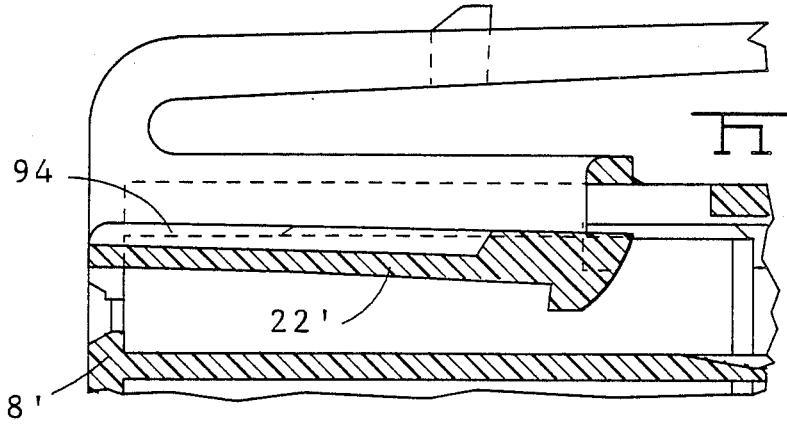
FIG. 13 is a sectional view of an alternate embodiment of a cantilever latch beam in which a longitudinal groove extends from the base toward the free end on the exterior of the beam. This configuration causes the end of the cantilever latch beam to be drawn inwardly toward the center of the cavity.

In the alternate embodiment of FIG. 13, a groove 94 extends of the exterior of the beam 22'. This groove 94 is otherwise similiar to groove 92. By forming groove 94 on the exterior of the housing, the beam 22' actually warps inwardly causing latching projection 24' to move toward the center of cavity 20'. It is possible that the shrinkage of the beam adjacent the cooler mating face 36' on the inner half of the beam is sufficient to overcome the shrinkage on the outer half, thus drawing the beam inwardly. Note that there is also less cross sectional area on the outer half of beam 22' because of the presence of the groove 94.

We claim:

1. An electrical connector comprising a plurality of terminals in cavities within a molded insulative housing, each terminal being retained within the housing by a molded cantilever latch beam comprising a part of the housing with a latching projection on the cantilever latch beam protruding into the corresponding cavity for engagement with an associated terminal, characterized in that the cantilever latch beam has a groove extending along one side from the beam base toward the beam free end of the cantilever latch beam so that a cross section of the cantilever latch beam through the groove is in the form of a U, the groove alleviating deformation of the molded cantilever latch beam resulting from differential cooling during solidification of the molded insulative housing.

2. The electrical connector of claim 1 wherein said groove is on the interior of the cantilever latch beam.

3. The electrical connector of claim 1 wherein said groove is on the exterior of the cantilever latch beam.

4. The electrical connector of claim 1 wherein said cantilever latch beam extends rearwardly from a mating face of the molded insulative housing.

5. The electrical connector of claim 4 wherein each groove opens onto the mating face and extends toward the latching projection.

6. The electrical connector of claim 5 wherein the insulative housing has two rows of cavities, said cantilever latch beams for cavities in the same row being positioned side by side.

7. The electrical connector of claim 6 wherein said cantilever latch beams comprise parts of an outer housing wall extending rearwardly from the mating face of the molded insulative housing.

* * * * *